US009177702B2

(12) United States Patent
Lo et al.

(10) Patent No.: US 9,177,702 B2
(45) Date of Patent: Nov. 3, 2015

(54) PTC COMPOSITION AND RESISTIVE DEVICE AND LED ILLUMINATION APPARATUS USING THE SAME

(71) Applicants: Kuo Chang Lo, New Taipei (TW); Wei Tsang Dai, Hsinchu (TW); Yi An Sha, New Taipei (TW); Chun Teng Tseng, Sanwan Township, Miaoli County (TW)

(72) Inventors: Kuo Chang Lo, New Taipei (TW); Wei Tsang Dai, Hsinchu (TW); Yi An Sha, New Taipei (TW); Chun Teng Tseng, Sanwan Township, Miaoli County (TW)

(73) Assignee: POLYTRONICS TECHNOLOGY CORP., Hsinchu (TW)

( * ) Notice: Subject to any disclaimer, the term of this patent is extended or adjusted under 35 U.S.C. 154(b) by 180 days.

(21) Appl. No.: 14/017,806

(22) Filed: Sep. 4, 2013

(65) Prior Publication Data

US 2014/0306605 A1 Oct. 16, 2014

(30) Foreign Application Priority Data

Apr. 12, 2013 (TW) ..... 102112955 A

(51) Int. Cl.

| | |
|---|---|
| ***H05B 33/00*** | (2006.01) |
| ***H01C 7/02*** | (2006.01) |
| ***H05B 33/08*** | (2006.01) |
| *H01C 17/065* | (2006.01) |

(52) U.S. Cl.

CPC ..... *H01C 7/028* (2013.01); *H01C 7/027* (2013.01); *H01C 17/06586* (2013.01); *H05B 33/0854* (2013.01); *H05B 33/0857* (2013.01); *H05B 33/0881* (2013.01); *H01C 17/0652* (2013.01); *H01C 17/06566* (2013.01)

(58) Field of Classification Search

CPC ..... H01C 7/028; H01C 7/02; H01C 7/027; H01C 17/06586; H01C 17/0652; H01C 17/06566; H05B 33/0857; H05B 33/0854; H05B 33/0881

See application file for complete search history.

(56) References Cited

U.S. PATENT DOCUMENTS

| | | | | |
|---|---|---|---|---|
| 5,589,823 | A * | 12/1996 | Lange | 340/622 |
| 8,421,370 | B2 * | 4/2013 | Kim | 315/291 |
| 8,779,685 | B2 * | 7/2014 | Wang et al. | 315/294 |
| 8,878,443 | B2 * | 11/2014 | Luo et al. | 315/185 R |
| 2007/0035378 | A1 * | 2/2007 | Wang et al. | 338/22 R |
| 2013/0070380 | A1 * | 3/2013 | Wang et al. | 361/93.8 |
| 2013/0249415 | A1 * | 9/2013 | Tseng et al. | 315/185 R |

FOREIGN PATENT DOCUMENTS

CN 102779798 A 11/2012

* cited by examiner

*Primary Examiner* — Jung Kim
(74) *Attorney, Agent, or Firm* — Egbert Law Offices, PLLC

(57) ABSTRACT

A PTC composition comprises crystalline polymer and conductive ceramic filler dispersed therein. The crystalline polymer has a melting point less than 90° C. and comprises 5%-30% by weight of the PTC composition. The crystalline polymer comprises ethylene, vinyl copolymer or the mixture thereof. The vinyl copolymer comprises at least one of the functional group selected from the group consisting of ester, ether, organic acid, anhydride, imide or amide. The conductive ceramic filler comprises a resistivity less than 500 μΩ-cm and comprises 70%-95% by weight of the PTC composition. The PTC composition has a resistivity about 0.01-5 Ω-cm and its resistance at 85° C. is about $10^3$ to $10^8$ times that at 25° C.

4 Claims, 1 Drawing Sheet

PTC COMPOSITION AND RESISTIVE DEVICE AND LED ILLUMINATION APPARATUS USING THE SAME

CROSS-REFERENCE TO RELATED APPLICATIONS

Not

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a positive temperature coefficient (PTC) composition, and a resistive device and an LED illumination apparatus using the PTC composition.

2. Description of Related Art Including Information Disclosed Under 37 CFR 1.97 and 37 CFR 1.98

Because the resistance of conductive composite materials having PTC characteristic is very sensitive to temperature variation, it can be used as the material for current sensing devices, and has been widely applied to over-current protection devices or circuit devices. The resistance of the PTC conductive composite material remains extremely low at normal temperature, so that the circuit or cell can operate normally. However, when an over-current or an over-temperature event, occurs in the circuit or cell, the resistance instantaneously increases to a high resistance state (i.e., trip) to decrease the current.

The conductivity of the PTC conductive composition depends on the content and type of the conductive fillers dispersed therein. In general, carbon black having rough surfaces can be well adhered to polyolefin, so it provides better resistance repeatability. The over-current protection devices applied to computing, communication or consumer products give weight to resistance repeatability performance, and therefore the conductive ceramic filler in the polymer often uses carbon black. Because the interacting forces among carbon black particles are strong, high density polyethylene (HDPE) is usually used as polymer matrix. However. HDPE has high melting point, resulting in that the PTC composition does not easily trip at a low temperature, and therefore it is not suitable for low-temperature trip applications. Moreover, even if using low-temperature trip polymeric material, the resistance increase after trip may be not sufficient in the case of the use of carbon black. For example, the resistance after trip may be only 100 times the initial resistance, and therefore the PTC composition still needs to be improved.

BRIEF SUMMARY OF THE INVENTION

The present application provides a PTC composition and a resistive device using the same, which can be applied to LED illumination adjustment.

According to a first aspect of the present application, a PTC composition comprises crystalline polymer and conductive ceramic filler dispersed therein. The crystalline polymer has a melting point less than 90° C. and comprises 5%-30% by weight of the PTC composition. The conductive ceramic filler has a resistivity less than 500 μΩ-cm and comprising 70%-95% by weight of the PTC composition. The PTC composition at 25° C. has a resistivity ranging from 0.01 to 5 Ω-cm, and a ratio of a resistance at 80° C. to a resistance at 25° C. of the PTC composition ranges from $10^3$ to $10^8$.

In order to trip at a low temperature, the crystalline polymer may use material having low melting temperature. The melting temperature may be less than 90° C., 80° C., or ranges from 30° C. to 70° C. in particular. The crystalline polymer may comprise ethylene, vinyl copolymer or the mixture thereof. The vinyl copolymer comprises at least one functional group selected from the group consisting of ester, ether, organic acid, anhydride, imide, amide or the mixture thereof. For example, the crystalline polymer may be ethylene vinyl acetate (EVA), ethylene ethyl acrylate (EEA), low-density polyethylene (LDPE) or the mixture thereof. The crystalline polymer may further comprise high-density polyethylene of high melting temperature to obtain an adequate melting temperature as desired.

The LDPE can be polymerized using Ziegler-Natta catalyst, Metallocene catalyst or the like, or can be copolymerized by vinyl monomer and other monomers such as butane, hexane, octene, acrylic acid, or vinyl acetate.

The conductive ceramic filler May comprises titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), zirconium nitride (ZrN), titanium nitride (TiN), or the mixture thereof. The conductive ceramic filler has a particle size ranging from 0.01 μm to 30 μm, or preferably front 0.1 μm to 10 μm.

In an embodiment, the trip temperature of the PTC composition is about 30° C. to 55° C.

To increase flame retardant, anti-arcing or voltage endurance performances, the PTC composition may further comprise non-conductive filler. The non-conductive filler may be, for example, magnesium oxide, magnesium hydroxide, aluminum oxide, aluminum hydroxide, boron nitride, aluminum nitride, calcium carbonate, magnesium sulfate, barium sulfate or the mixture thereof. The non-conductive filler is 0.5% to 20%, or preferably 1% to 5% by weight of the PTC composition. The particle size of the non-conductive filler is mainly between 0.05 μm and 50 μm.

According to a second aspect of the present application, a resistive device comprises two conductive layers and a PTC material layer laminated therebetween. The PTC material layer comprises the aforesaid PTC composition.

According to a third aspect of the present application, an LED illumination apparatus comprises a first LED component and a PTC device. The first LED component is sensitive to temperature variation in terms of brightness. The PTC device is adjacent to the first LED component and capable of effectively sensing a temperature of the first LED component. The resistance of the PTC device at 85° C. is about $10^3$ to $10^8$ times that at 25° C. In an embodiment, the LED illumination apparatus ma further comprise a second LED component connected to the first LED component in series or in parallel. The first LED component exhibits worse luminous decay than the second LED component. For example, the first LED component comprises red-light LED, and the second LED component comprises white-light LED. The PTC device may connect to the first LED component in parallel and connect to the second LED component in series.

The PTC device of the present application uses polymer with low melting point and conductive ceramic filler with low resistivity, by which the device can trip at a low temperature and the resistance after trip can increase significantly. As such, the PTC device can be employed for relevant applications.

BRIEF DESCRIPTION OF THE SEVERAL VIEWS OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific was to make and use the invention, and do not limit the scope of the invention.

The PTC composition and the manufacturing process thereof are exemplified below. In an embodiment, the PTC composition and weight (grams) are shown in Table 1. The crystalline polymer comprises the polymers of melting points less than 90° C. or 80° C., such as ethylene vinyl acetate (EVA), ethylene ethyl acrylate (EEA), low-density polyethylene (LDPE) or the mixture thereof. The melting temperature of the crystalline polymer may be 85° C., or preferably between 40° C. and 80° C. or between 30° C. and 70° C. High-density polyethylene (HDPE) with high melting point may be further added. The conductive ceramic filler has a resistivity less than 500μΩ-cm such as titanium carbide, tungsten carbide or the mixture thereof. The particle size of the conductive ceramic filler ranges from 0.1 μm to 10 μm, and the aspect ratio is less than 100, or less than 20 or 10 in particular. In practice, the conductive ceramic filler may be of various shapes such as spherical, cubic, flake, polygon or column shapes. Because the conductive ceramic filler usually has high hardness, the making process is different from that of carbon black or metal powder. Therefore, the shape of ceramic filler is different from that of carbon black or metal powder of high structure. The conductive ceramic filler is mainly of low structure. A non-conductive filler uses magnesium hydroxide ($Mg(OH)_2$). In a comparative example, the conductive filler is carbon black (CB).

In an embodiment, the manufacturing process of the PTC composition is described as follows. The raw material is fed into a blender (HAAKE 600) at 160° C. for two minutes. The procedure of feeding the raw material includes adding the crystalline polymers with the amounts according to Table 1 into the blender; after blending for a few seconds, then adding the conductive ceramic filler of particle size between 0.1 μm and 50 μm and the non-conductive filler. The rotational speed of the blender is set at 40 rpm. After blending for three minutes, the rotational speed increases to 70 rpm. After blending for 7 minutes, the mixture in the blender is (trained and thereby a conductive composition with PTC characteristic is obtained.

Figure 1:
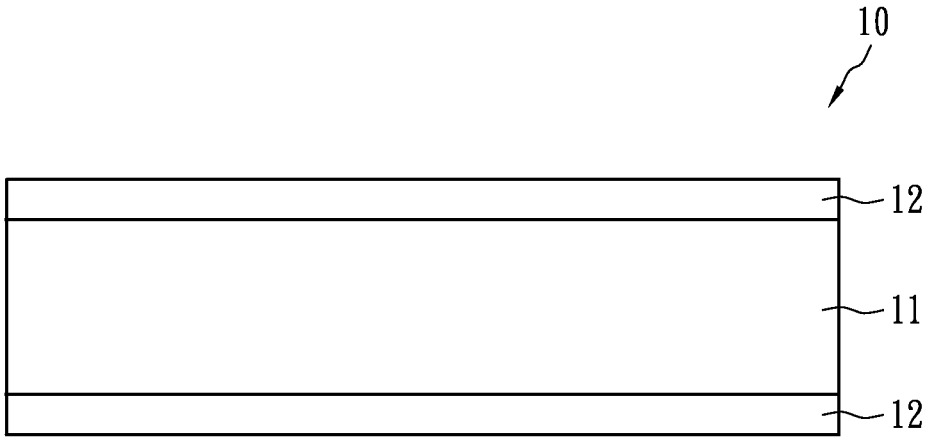
FIG. 1 shows a PTC device in accordance with the present application.

The above conductive composition is loaded symmetrically into a mold with outer steel plates and a 0.35 mm thick middle, wherein the top and the bottom of the mold are disposed with a Teflon cloth. The mold loaded with the conductive composition is pre-pressed for three minutes at 50 kg/cm$^2$ and 180° C. Then the generated gas is exhausted and the mold is pressed for 3 minutes at 100 kg/cm$^2$, 180° C. Next, another press step is performed at 150 kg/cm$^2$ and 180° C. for three minutes to form a PTC material layer 11, as shown in FIG. 1. In an embodiment, the thickness of the PTC material layer 11 is 0.35 mm or 0.45 mm.

The PTC material layer 11 may be cut into many square pieces each with an area of 20×20 cm$^2$. Then two conductive layers 12, e.g., metal foils, are pressed to physically contact the top surface and the bottom surface of the PTC material layer 11, in which the two conductive layers 12 are symmetrically placed upon the top surface and the bottom surface of the PTC material layer 11. Next, buffers, Teflon cloths and the steel plates are placed on the metal foils and are pressed to form a multi-layered structure. The multi-layer structure is pressed again at 180° C. and 70 kg/cm$^2$ for three minutes. Next, the multi-layered structure is punched or cut to form a PTC device (PTC chip) 10 with an area of 3.4 mm×4.1 mm or 3.5 mm×6.5 mm. In an embodiment, the conductive layers 12 may contain rough surfaces with nodules. More specifically, the PTC device 10 is a laminated structure and comprises two conductive layers 12 and a PTC material layer 11 sandwiched between the two conductive layers 12.

The PTC devices of some embodiments and a comparative example are subjected to R-T tests, i.e., resistance v. temperature tests. The resistances at 25° C., 40° C. or 85° C., which may be before and after trip, are shown in Table 1. At 25° C., the initial resistances for Em. 1 to Em. 5 are less than 1Ω, and the initial resistance of the Comp., however, has larger resistance. At 40° C., Em. 1, 2, 4 and 5 already exceed their corresponding trip temperatures, and therefore the resistance increases rapidly. However, Em. 3 has yet to reach its trip temperature, and thus the increase of resistance is not as obvious as Em. 1, 2, 4 and 5. At 80° C. the resistances of Em. 1 to Em. 5 are about $10^4$ to $10^8$Ω; it is obvious that the resistances increase tremendously. The resistance of Comp. is

TABLE 1

| | EVA | EEA | LDPE | HDPE | $Mg(OH)_2$ | CB | WC | TiC | Trip (° C.) | R (Ω) 25° C. | R (Ω) 40° C. | R (Ω) 80° C. |
|---|---|---|---|---|---|---|---|---|---|---|---|---|
| Em. 1 | 11 | 3 | 3 | — | 4 | — | — | 120 | 38 | 0.08 | 70 | $10^8$ |
| Em. 2 | 11 | 4 | 5 | — | 5 | — | 260 | — | 36 | 0.1 | 32 | $10^4$ |
| Em. 3 | 9 | 4 | 5 | — | 5 | — | 220 | 30 | 48 | 0.1 | 0.8 | $10^4$ |
| Em. 4 | 0 | 20 | — | — | — | — | 315 | — | 30 | 0.1 | 0.6 | $10^4$ |
| Em. 5 | 0 | 26 | — | — | — | — | 68 | — | 35 | 0.8 | 17 | $10^4$ |
| Em. 6 | 7.5 | — | — | 7.5 | — | — | — | 117 | 40 | 0.0.3 | 55 | $10^4$ |
| Comp | 17 | 6 | 2 | — | 5 | 22 | — | — | 60 | 1.6 | 20 | 130 |

only 130Ω; it indicates that the device using carbon black as conductive filler cannot obtain sufficient resistance increase after trip. Besides, the trip temperature of Comp. is about 60° C., and cannot meet the requirement of low-temperature trip.

The resistivity ρ of the PTC material layer 11 can be obtained in light of formula (1):

$$\rho = \frac{R \times A}{L} \quad (1)$$

where R, A, and L indicate the resistance (Ω), the area ($cm^2$) and the thickness (cm) of the PTC material layer 11, respectively. Substituting the initial resistance Ri of 0.08Ω (Refer to the resistance of Em. 1 at 25° C. of Table 1), the area of 6.5×3.5 $mm^2$ (=6.5×3.5×$10^{-2}$ $cm^2$) and the thickness of 0.45 mm (0.045 cm) for R, A, and L in formula (1), respectively, a volume resistivity (ρ) of 0.4 Ω-cm is obtained.

More specifically, the trip temperature of the PTC composition ranges from 30° C. to 55° C. or 40° C., 45° C. or 50° C. in particular. The resistivity of the PTC composition is in the range of 0.01 to 5 Ω-cm, or 0.05 Ω-cm, 0.1 Ω-cm, 0.5 Ω-cm, 1 Ω-cm, 1.5 Ω-cm, or 2 Ω-cm in particular. In addition, the resistance of the PTC composition at 80° C. is $10^3$ to $10^8$ times the resistance at 25° C. This ratio may be $10^4$, $10^5$, $10^6$ or $10^7$. The crystalline polymer comprises 5% to 30% by weight of the PTC composition, and may comprise 10%, 15%, 20% or 25% by weight of the PTC composition. The conductive ceramic filler comprises 70% to 95%, or 75%, 80%, 85% or 90% in particular, by weight of the PTC composition.

In practice, the conductive ceramic filler may comprise titanium carbide, tungsten carbide, vanadium carbide, zirconium carbide, niobium carbide, tantalum carbide, molybdenum carbide, hafnium carbide, titanium boride, vanadium boride, zirconium boride, niobium boride, molybdenum boride, hafnium boride, zirconium nitride, titanium nitride, and the mixture thereof. The particle site of the conductive ceramic filler ranges from 0.01 to 30 μm, and preferably from 0.1 to 10 μm.

It can be seen from Table 1 that, by introducing, conductive ceramic filler and crystalline polymer having a melting point less than 90° C., the PTC composition exhibits a low initial resistance, low-temperature trip and significant resistance increase after trip.

Because the resistivity of conductive ceramic filler is very low, e.g., less than 500 μΩ-cm, the PTC composition containing the same may have a resistivity less than 5 Ω-cm. Generally, the PTC composition of low resistivity cannot withstand high voltage. It is advantageous to contain non-conductive filler in the PTC composition to increase voltage endurance. The non-conductive filler may comprise magnesium oxide, magnesium hydroxide, aluminum oxide, aluminum hydroxide, boron nitride, aluminum nitride, calcium carbonate, magnesium sulfate, barium sulfate, or the mixture thereof. The non-conductive filler may comprise 0.5-20%, or preferably 1-5%, by weight of the PTC composition. The particle size of the non-conductive filler ranges from (0.05 μm to 50 μm. The non-conductive filler further improves resistance repeatability, in which a ratio R1/Ri less than 3 is obtainable, where Ri is initial resistance and R1 is the resistance measured at one hour after trip.

LEDs are usually less bright and have short lifetimes if they are of high temperature. Therefore, LED temperature (temperature of p-n junction) is usually controlled in the range from 35° C. to 85° C. To increase color rendering of LED light, a red-light LED component and a white-light LED component are connected in series often. However, the red-light LED component has much worse thermally luminous decay than the white-light LED component, i.e., the brightness of the red-light LED component is highly sensitive to temperature variation, so that the LED light may change color after using for a certain time period. The PTC composition of the present application can be applied to solve the problem of red-light LED thermally luminous decay.

Figure 2:
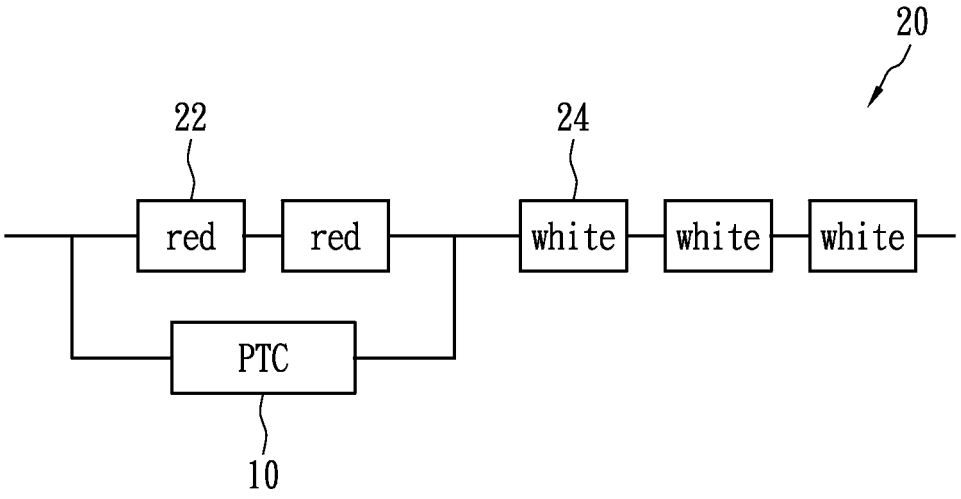
FIG. 2 shows an LED illumination apparatus in accordance with the present application.

In FIG. 2, an LED illumination apparatus 20 comprises a red-light LED component 22 and a white-light LED component 24 and a PTC device 10 as mentioned above. The red-light or white-light LED component may comprises one or more illuminating LEDs. The red-light LED component 22 and the white-light LED component 24 are connected in series, and the PTC device 10 connects to the red-light LED component 22 in parallel. The PTC device 10 is adjacent to the red-light LED component 22 to effectively sense the temperature of the red-light LED component 22. When the LED illumination apparatus 20 is powered on, the PTC device 10 remains at low resistance to allow current to flow therethrough. In other words, current, goes through the red-light LED component 22 and the PTC device 10 in parallel connection. When the red-light LED component 22 heats up gradually, the PTC device 10 will sense the temperature of the red-light LED component 22 and accordingly heat up. As a result, the resistance of the PTC device 10 increases, thereby decreasing current flowing, therethrough and, in contrast, increasing current flowing, through the red-light LED component 22. Accordingly, the thermally luminous decay of the rod-light LED component 22 can be improved. The PTC composition capable of low-temperature trip can be used for relevant applications such as the compensation to color-rendering of the LED illumination. In other cases, the white-light LED component and the red-light. LED component may be in parallel connection.

In an embodiment, two leads, e.g., nickel strips, may be soldered or spot-welded to the two conductive layers of the PTC device to form an assembly, which may be axial-leaded, radial-leaded, terminal, or surface mount type, for other low-temperature trip applications.

The above-described embodiments of the present invention are intended to be illustrative only. Numerous alternative embodiments may be devised by persons skilled in the art without departing from the scope of the following claims.

We claim:

1. An LED illumination apparatus comprising:

a first LED component being sensitive to temperature variation in terms of brightness; and a PTC device connected to the first LED component in parallel and being adjacent to the first LED component to effectively sense a temperature of the first LED component, a ratio of a resistance at 80° C. to a resistance at 25° C. of the PTC device ranging from $10^3$ to $10^8$, wherein the PTC device comprises two conductive layers and a PTC material layer laminated between the two conductive layers, wherein the PTC material layer comprises:

a crystalline polymer having a melting point less than 90° C. and comprising 5%-30% by weight of the PTC material layer, the crystalline polymer comprising ethylene or vinyl copolymer, the vinyl copolymer comprising at least one functional group selected from the group consisting of ester, ether, organic acid, anhydride, imide, amide and mixtures thereof; and a conductive ceramic filler dispersed in the crystalline polymer, the conductive ceramic filler having a resistivity less than 500 μΩ-cm and comprising 70%-95% by weight of the PTC material layer.

2. The LED illumination apparatus of claim 1, further comprising a second LED component connected to the first LED component in series or in parallel, the first LED component having a worse thermally luminous decay than a thermally luminous decay of the second LED component.

3. The LED illumination apparatus of claim 2, wherein the first LED component comprises a red-light LED and the second LED component comprises a white-light LED.

4. The LED illumination apparatus of claim 1, wherein the PTC device has a trip temperature ranging from 30° C. to 55° C.

* * * * *